US009457876B1

(12) United States Patent
Godfrey et al.

(10) Patent No.: US 9,457,876 B1
(45) Date of Patent: Oct. 4, 2016

(54) MULTIPLE STRAND POOL NOODLE

(71) Applicant: Hickory Springs Manufacturing Company, Hickory, NC (US)

(72) Inventors: Jonathan Wesley Godfrey, Hickory, NC (US); Joseph Shawn Huffman, Hickory, NC (US)

(73) Assignee: HICKORY SPRINGS MANUFACTURING COMPANY, Hickory, NC (US)

( * ) Notice: Subject to any disclaimer, the term of this patent is extended or adjusted under 35 U.S.C. 154(b) by 0 days.

(21) Appl. No.: 14/495,518

(22) Filed: Sep. 24, 2014

Related U.S. Application Data

(60) Provisional application No. 61/882,765, filed on Sep. 26, 2013.

(51) Int. Cl.
*B63C 9/08* (2006.01)
*B63B 35/74* (2006.01)
*B63B 35/00* (2006.01)

(52) U.S. Cl.
CPC ..... *B63B 35/74* (2013.01); *B63B 35/00* (2013.01)

(58) Field of Classification Search
CPC ..... B63B 35/74; B63B 35/00
USPC ..... 441/129
See application file for complete search history.

(56) References Cited

U.S. PATENT DOCUMENTS 5,571,036 A * 11/1996 Hannigan ..... B63B 35/78 441/129
2009/0156086 A1* 6/2009 Hartings ..... A63H 23/005 446/124
2010/0203781 A1* 8/2010 Gellatly ..... B32B 27/12 441/129
2015/0013091 A1* 1/2015 DiBelardino ..... A47K 7/03 15/209.1

* cited by examiner

*Primary Examiner* — Stephen Avila
(74) *Attorney, Agent, or Firm* — Perkins Coie LLP

(57) ABSTRACT

A multiple strand pool noodle is provided. The multiple strand pool noodle has at least two strands formed of extruded foam where each of the strands has a first end and a second end. The first ends of the strands are contained in a first end member and the second ends of the strand are contained in a second end member. A length of the strands extends between the first and second end members. The strands are movable with respect to each other along the length.

20 Claims, 12 Drawing Sheets

MULTIPLE STRAND POOL NOODLE

CROSS-REFERENCE TO RELATED PATENT APPLICATIONS

The present application claims the benefit of U.S. Provisional Patent Application Ser. No. 61/882,765, filed Sep. 26, 2013, the disclosure of which is incorporated herein by reference as if set out in full.

BACKGROUND

The pool noodle is a flotation device usable in water, typically a pool. While ubiquitous today, the pool noodle has only been a water toy since about the mid 1980s.

With reference to FIG. 1, a conventional (or original) pool noodle 100 is shown. The pool noodle 100 is formed of extruded foam, such as a polyethylene, polypropylene, or polyurethane foam. The extruded foam is cut at an appropriate length for the particular use. The extruded elongated foam element is called a "noodle" because its shape is similar and its flexibility is similar to noodles. In part, due to the extrusion process, the pool noodle 100 has a hollow bore 102 extending through the center of the pool noodle 100. Conventionally, the pool noodle has a diameter 104 of about 2 to 4 inches and a length 106 of between 1 to 7 feet, depending often on the desired use.

The pool noodle 100 is highly buoyant and is often used as a personal flotation device where a swimmer holds the pool noodle 100 and the buoyancy of the pool noodle 100 supports the swimmer. The pool noodle's flexibility allows for alternative uses as well. In some embodiments, the pool noodle 100 may be formed into a square shape (either continuously or cut) to form a floating holder for a cooler of beverages in a body of water. In other instances, a rope may be threaded in the hollow bores 102 over a plurality of pool noodles 100 to a string of pool noodles. In still other instances, a pool noodle 100 may be formed into a shape, such as a U, L, or V shape and used by an individual.

Pool noodles 100 may also be used, in certain applications, as swords or jousting items to allow individuals to safely have a mock battle. In other non-traditional uses, the hollow bore 102 of the pool noodle 100 may be filed with fluid and used as a water gun.

Despite the many and varied uses for pool noodle 100, the pool noodle 100 remains essentially a single piece of extruded foam. Thus, against this background, improved pool noodles are desirous.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In some aspects of the technology, a multiple strand pool noodle is provided. The multiple strand pool noodle comprises a plurality of elongate foam members, which may be hollow, joined at each end by a cap member. The cap member may be cylindrical with opposed open ends or cylindrical with one a closed end. In some embodiments, the cap member may be circular, elliptical, oval, oblong, rectangular, square, triangular, rhomboid, or a random shape as desired to form the overall end shapes of the multiple strand pool noodle.

In one embodiment, the multiple strand pool noodle comprises a least two (2) strands of extruded small diameter elongate foam members that are captured in end caps at opposing ends of the strands. The ends of the two (2) strands and the cap may be bonded by melt forming the ends.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to pool noodles. However, the technology described herein may be used for other applications outside of pools, such as, for example, use in water parks, other bodies of water, or uses outside of water, and the like. For example, the technology of the present application may be applicable to sledding, or the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
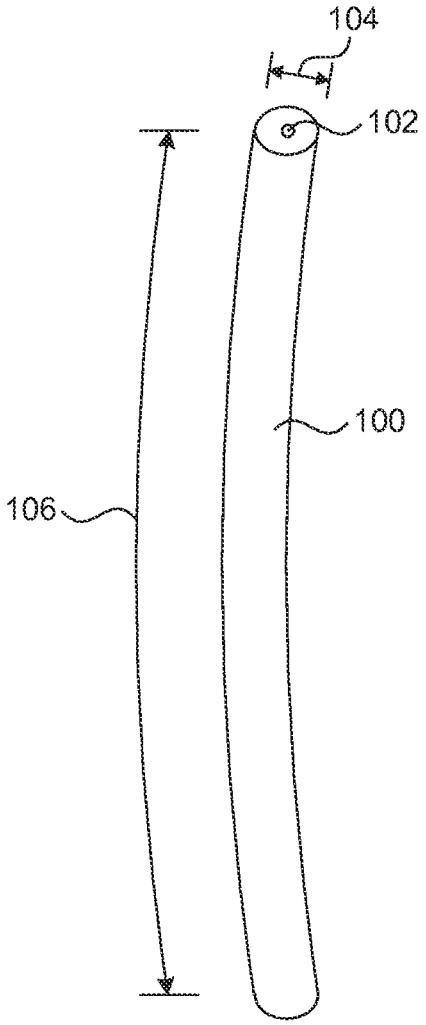
FIG. 1 is a perspective view of a prior art pool noodle.
Figure 2:
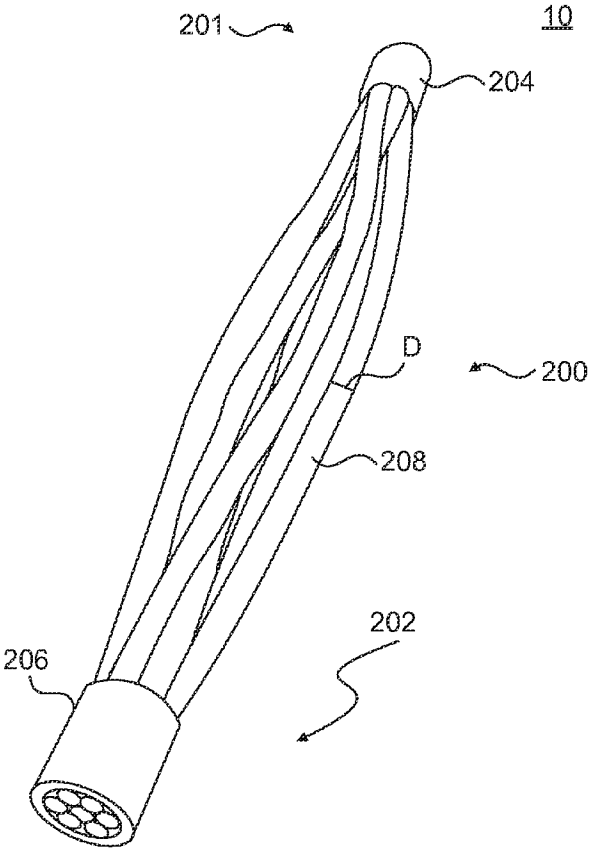
FIG. 2 is a perspective view of a multiple strand pool noodle consistent with the technology of the present application.

With reference now to FIG. 2, a multiple strand pool noodle 200 is shown floating in a pool 10. The multiple strand pool noodle 200 comprises a first end 201 and a second end 202 opposite from the first end 201. The multiple strand pool noodle 200 comprises a first end member 204 at the first end 201 and a second end member 206 at the second end. The multiple strand pool noodle 200 comprises a plurality of strands 208, which in this case, is seven (7) individual strands 208. Each strand 208 is itself an extruded foam member, generally hollow in view of the extrusion process presently used, but solid strands 208 are contemplated by the technology of the present application. The strands 208 each may be a conventional pool noodle, such as the elongate foam member 100 above, having a diameter between about 2 to 4 inches. However, as shown, the multiple strand pool noodle 200 comprises elongate extruded foam members having a diameter D of approximately 1 to 3.5 inches. In certain aspects, the diameter may be between about 1.5 and 1.75 inches. In some embodiments herein, the diameters may be less than 1 inch to 1 inch. As used herein in conjunction with dimensions, approximately and about mean within manufacturing tolerances, and for this type of product may be ±10%. Also, while shown as identically sized and shaped strands, the strands 208 may be of varied sizes and shapes. For example, instead of seven (7) circular cross-section members, the strands may include other cross-sectional shapes including, circular, triangular, rectangular, star, crescent, oval, tear drop, or the like. Generally, however, the length of the strands 208 forming the single multiple strand pool noodle 200 are of about the same length to couple with the ends 204, 206.

The first and second end members 204, 206 in this embodiment are formed of foam similar to the strands 208. In this exemplary embodiment, first and second end members 204, 206 may be formed from extruded foam similar to the strands 208 (or 100 above). In some embodiments, the first and second end members 204, 206 may be formed from a sheet of foam material made in any conventional manner and wrapped about the strands 208. If formed of a sheet of foam material, the seam (not specifically shown) would be heat fused or otherwise adhered to form the first and second end members 204, 206. The seam may be otherwise adhered using glues or other weld technologies that are applicable.

Figure 3:
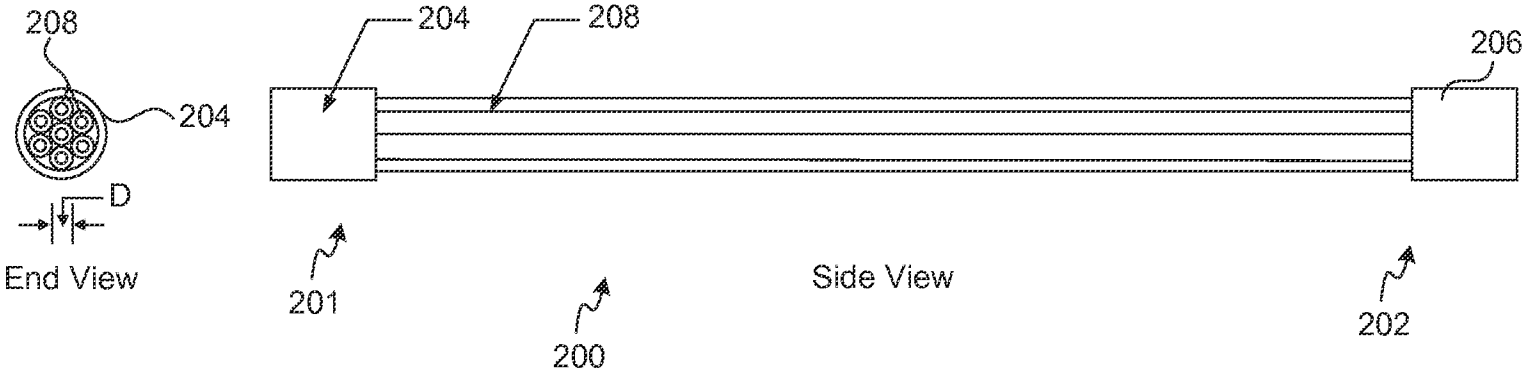
FIG. 3 is an elevation and end view of the multiple strand pool noodle shown in FIG. 2.

With reference now to FIG. 3, an elevation view and an end view of the multiple strand pool noodle 200 is shown. As can be seen in the end view, the first end portion 204 (and similarly second end portion 206), in this exemplary embodiment, is a tubular member that is open on both ends such that the strands 208 may extend from one or both sides of the first end portion 204, which is useful in one method of constructing the multiple strand pool noodle described further below. In some embodiments, however, the first (and/or second) end portion 204 (206) may include a cover such that the ends of the individual strands are not viewable when the multiple strand pool noodle 200 is constructed. As can be seen from the end view, the strands 208 are symmetrically arranged with six (6) strands side to side about a single center strand. While shown as seven (7) strands, the multiple strand pool noodle 200 having end members with a generally circular first and second end members 204 and 206 could have as little as three (3) strands to an almost unlimited number of strands.

Figure 4:
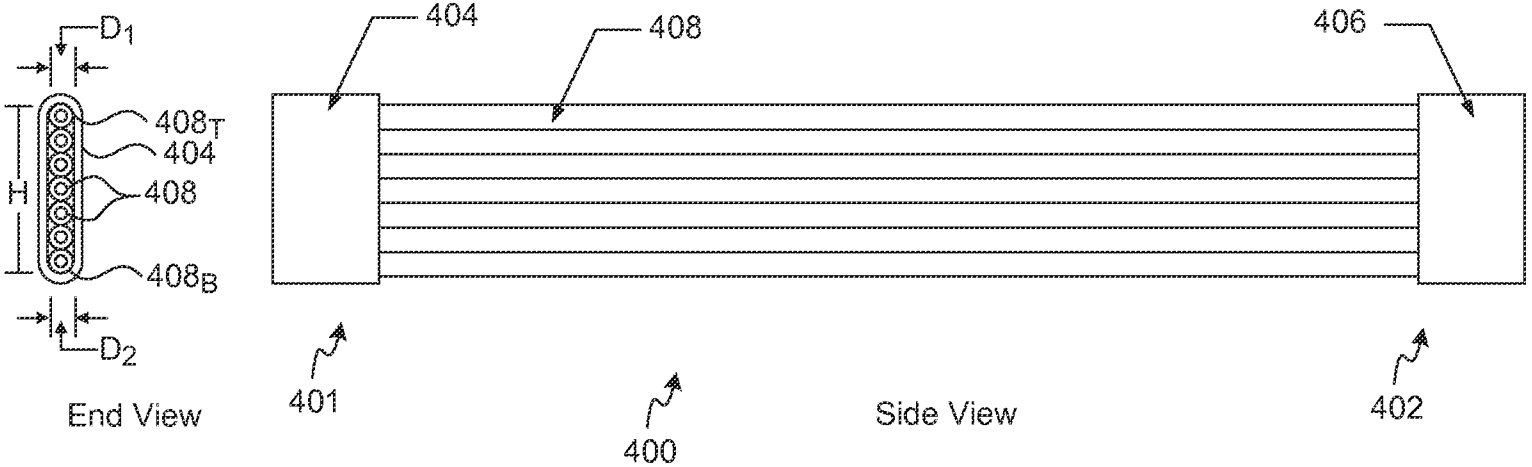
FIG. 4 is an elevation and end view of a multiple strand pool noodle consistent with the technology of the present application.

With reference now to FIG. 4, a multiple strand pool noodle 400 is shown. Similar to multiple strand pool noodle 200 above, multiple strand pool noodle 400 has a first end 401 with a first end member 404 and a second end 402 opposite the first end 401 with a second end member 406. The multiple strand pool noodle 400 further has a plurality of strands 408 that, in this exemplary embodiment, include seven (7) strands 408 although the multiple strand pool noodle may contain two (2) or more. As can be seen from the end view, the inner width $D_2$ of the first and second end members 404, 406 is approximately equal to the diameter $D_1$ of the strands 408. Moreover, the inner height H of the first and second end members 404, 406 is approximately equal to the diameter $D_1$ of the strands 408 times the number of strands that are stacked, which in this case is seven (7).

Figure 5:
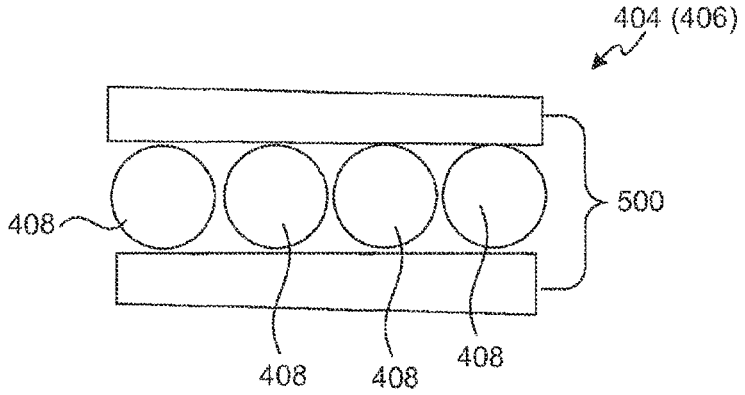
FIG. 5 is an end view of a multiple strand pool noodle consistent with the technology of the present application.

As shown in FIG. 4, the first and second end members 404, 406 are formed by an oblong tubular member that wraps around the top and bottom strands $\mathbf{408}_T$, $\mathbf{408}_B$. Alternatively, as discussed above, the first and second end members 404, 406 may be formed from a single sheet of foam material that is wrapped about the strands 408. In still another embodiment, the first and second end members 404, 406 may be formed from multiple sheets of foam 500 as shown in an elevation view in FIG. 5.

Figure 6:
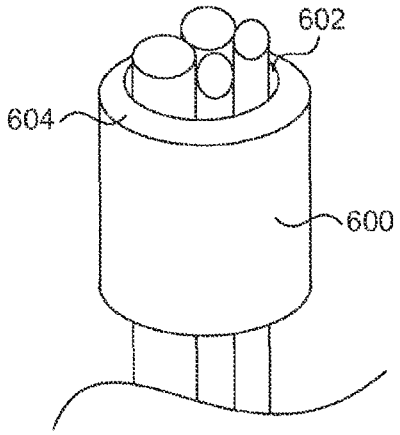
FIG. 6 is a view of the multiple strand pool noodle consistent with the technology of the present application.
Figure 7:
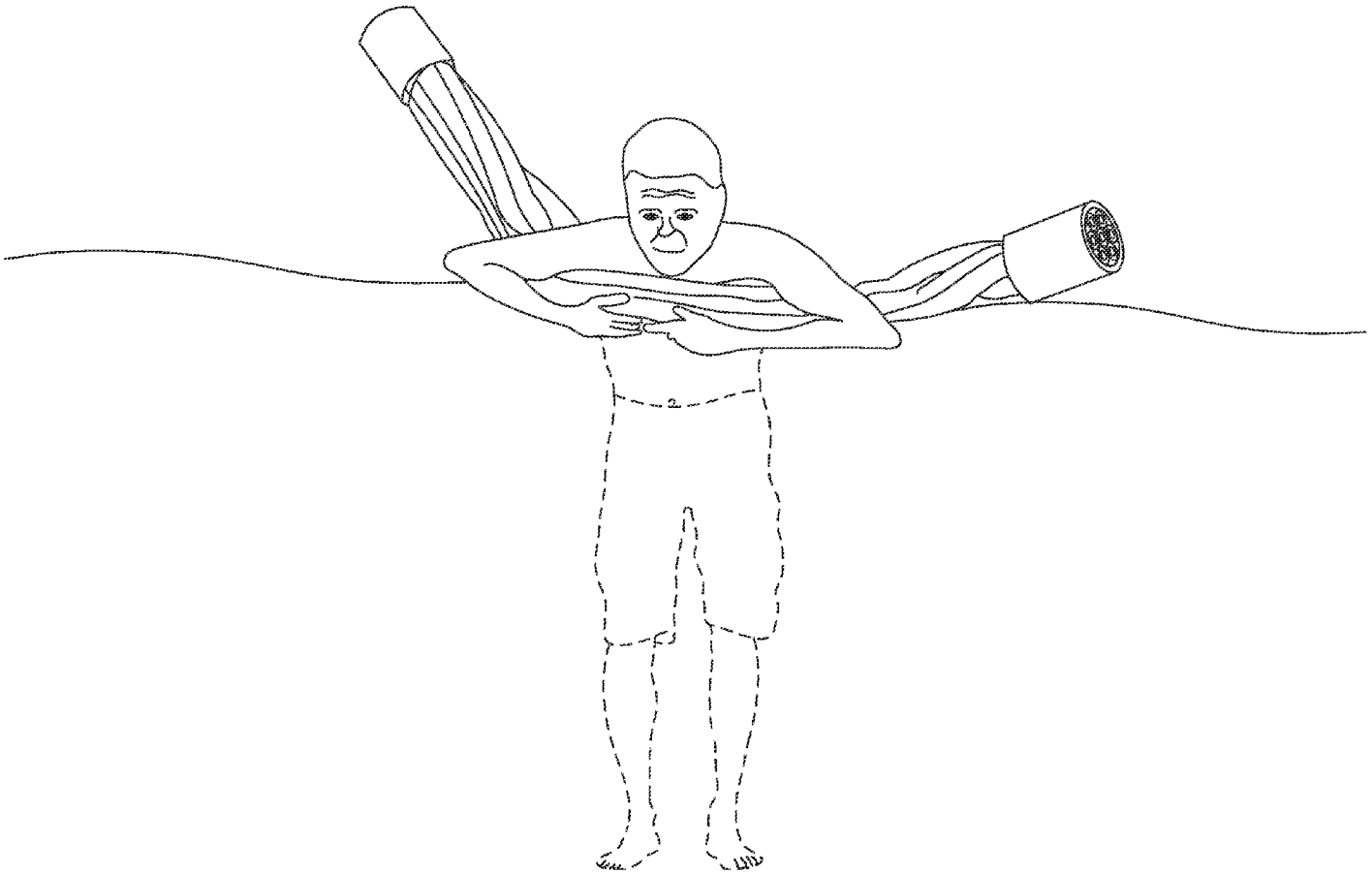
FIGS. 7-13 are views of use of the multiple strand pool noodle consistent with the technology of the present application.

In one exemplary embodiment, manufacturing the multiple strand pool noodle 200 or 400 comprises gathering the determined amount of strands 208 or 408. The strands 208, 408 are placed into the first and second end members 204, 206 or 404, 406 with an excess length of the strands 208 or 408 sticking out the end. The excess length does not need to be uniform for each of the strands 208, 408. For example, as shown in FIG. 6, an end member 600 is shown with four (4) strands 602. The end member 600 has an end surface 604. The strands 602 each extend beyond the end surface 604. The strands are organized such that the lengths are similar (although not necessarily uniform) and sticking out of the end member 600 beyond the end surface 604 by approximately ½" in this exemplary embodiment. More or less of the strand ends may extend from the end member in other embodiments. The end member 600 and strands 602 are heated as a group and allowed to melt together for approximately 2-3 seconds. Subsequent to the melting, cooling may be applied to cure the multiple strand pool noodle. The individual pieces outlined above are now joined to each adjacent edge beside it such that the end member 600 and the strands for an integrated unit with a smooth end surface. Instead of melting the ends to form an integrated or monolithic unit, the strands and end members may be welded, glued, or chemically bonded.

Figure 8:
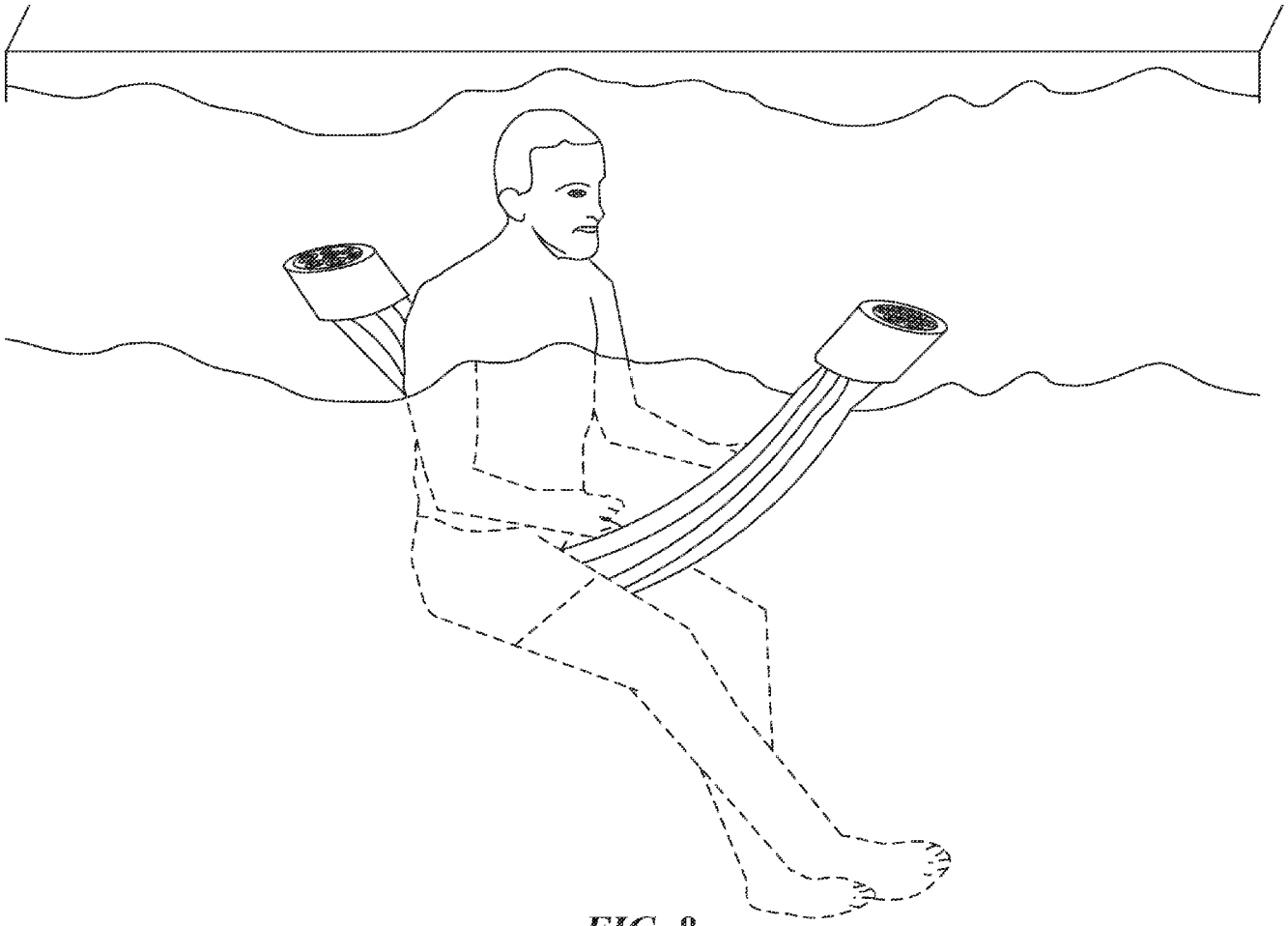
Figure 9:
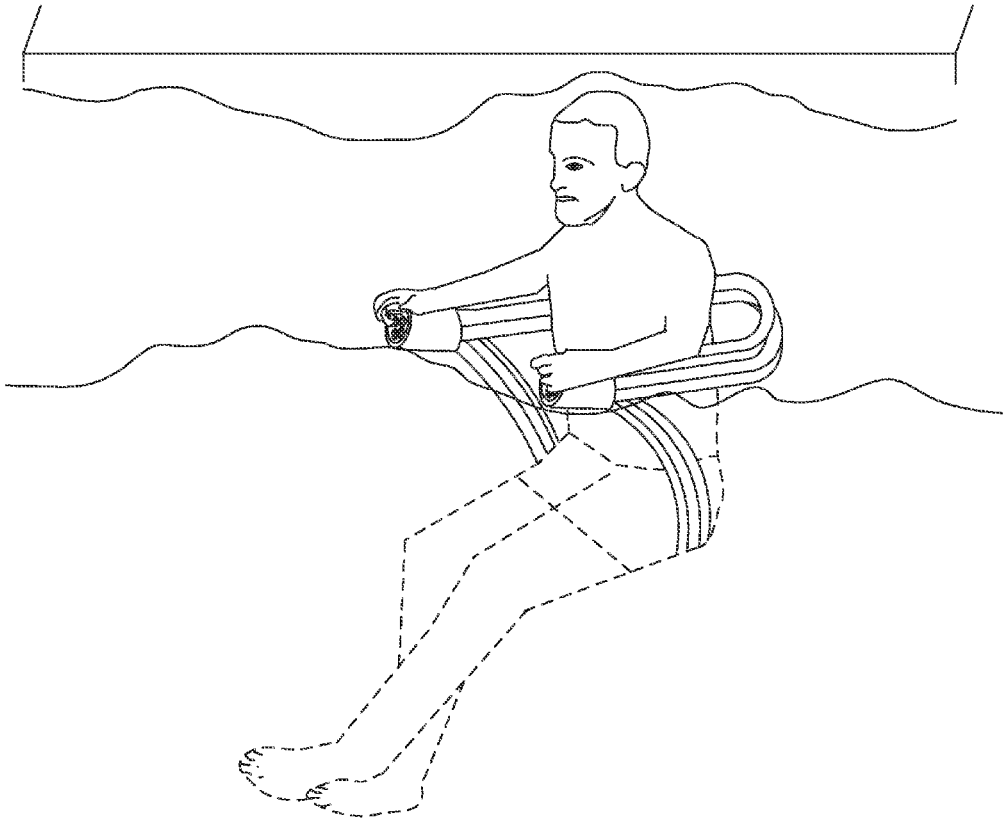
Figure 10:
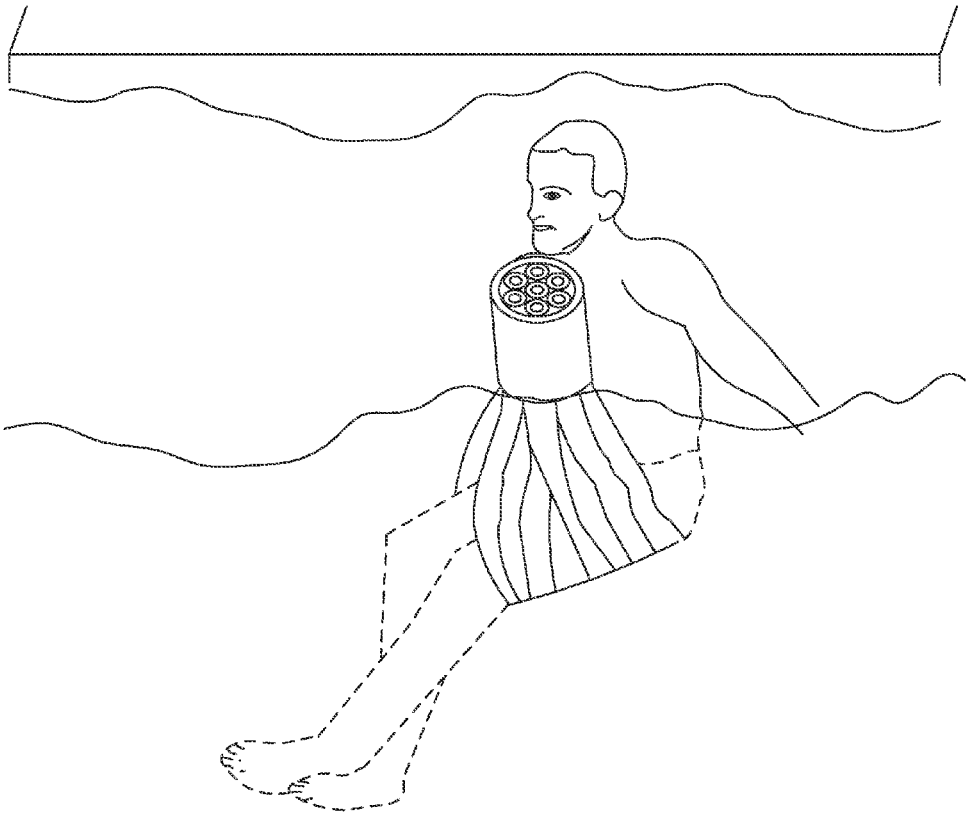
Figure 11:
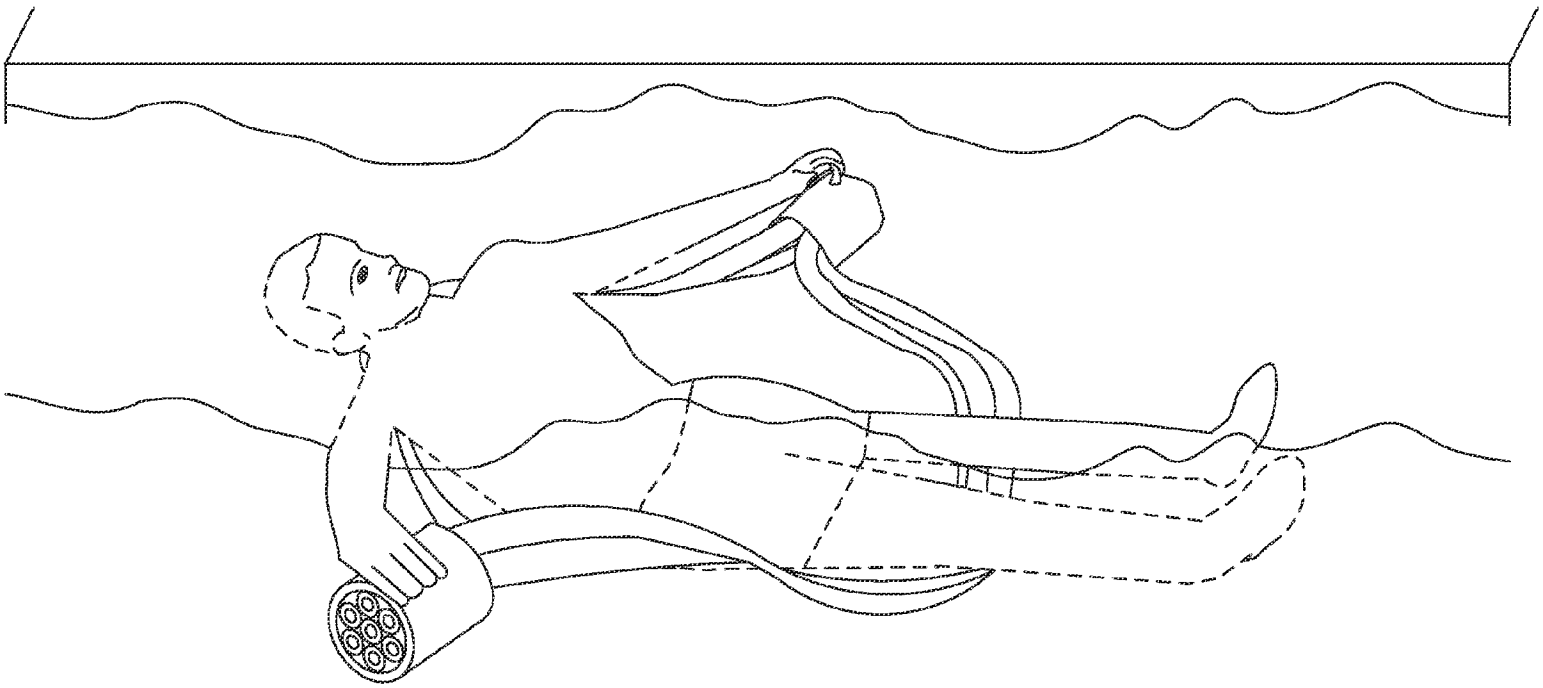
Figure 12:
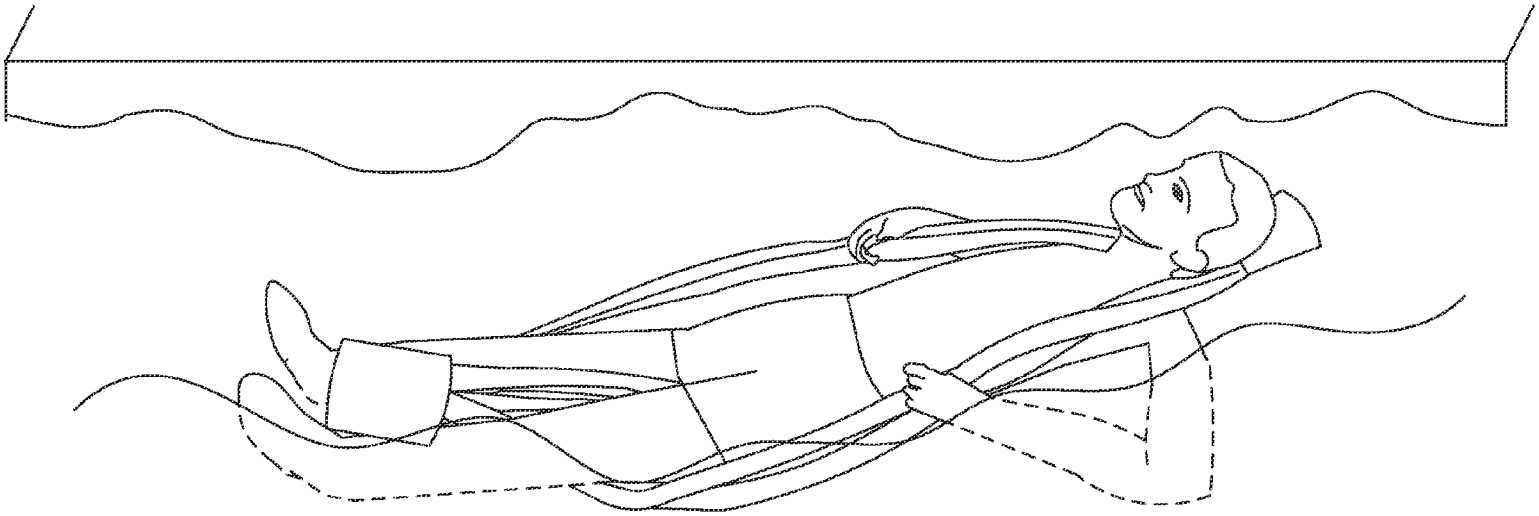
Figure 13:
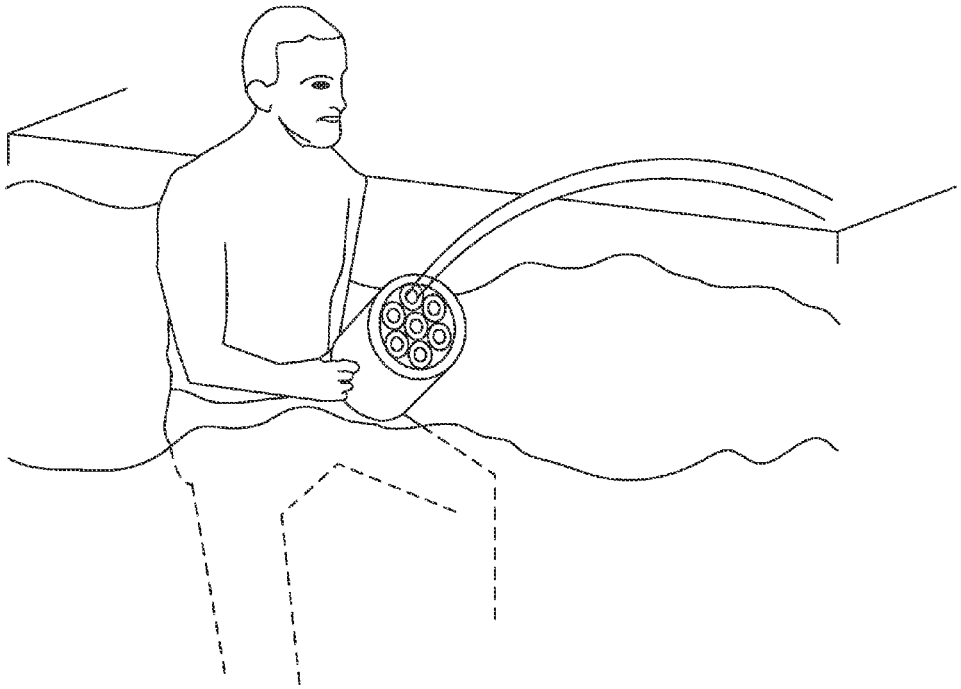

With reference now to FIGS. 7 to 13, the versatility of the multiple strand pool noodle 200 is demonstrated. First, with reference to FIG. 7, the multiple strand pool noodle 200 is usable as a conventional pool noodle. In this use, the swimmer grasps the multiple strand pool noodle 200 as a conventional flotation device. FIG. 8 shows another use of the multiple strand pool noodle 200 that is similar to a conventional use of a conventional flotation device. In this application, the pool noodle is used as a seat in a U-shaped harness. With reference to FIGS. 9 and 10, the multiple strand pool noodle 200 is used in a seat configuration. In particular, the strands are separated to form various seat configurations. For example, in FIG. 9, several of the strands 208 are arranged across the back of the swimmer and several of the strands 208 are arranged across the thigh/buttocks region. The configuration of the multiple strand pool noodle 200, in FIG. 9, provides a floating seat with a back support. Similarly, with reference to FIG. 10, the strands 208 are fanned out in a planar arrangement under the thigh/buttocks region of the swimmer. This configuration provides a stable, generally flat seating surface (similar to a sling or seat hammock) for the swimmer as opposed to the generally round surface shown by the inverted U-shaped harness of FIG. 8. FIGS. 11 and 12 show a lounge configuration for a pool use of the multiple strand pool noodle 200 not possible with a conventional pool noodle 100. With reference to FIG.

11, for example, a first plurality of the strands 208 are fanned out to support the upper back, neck, and head of the swimmer and a second plurality of strands 208 are fanned out to support the legs, shown in the knee region. This allows the swimmer to rest in the supine position on a single multiple strand pool noodle 200. Similarly, FIG. 12 shows the use of the multiple strand pool noodle 200 in another lounge configuration. In this configuration, at least one strand of the strands 208 are used on the left and right side of the supine swimmer as a sort of guard rail. The remainder of the strands 208 are fanned out and extend under the back generally parallel to the spinal column. Finally, the first (or second) end 201 (or 202) and the first end member 204 (or the second end member 206) may be used as a head rest. Finally, in FIG. 13, the multiple strand pool noodle 200 may be used similar to a conventional pool noodle 100 as a means of launching liquid, similar to a squirt gun.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

We claim:

1. A multiple stand pool noodle, comprising:

a plurality of extruded foam members, each of the plurality of extruded foam members comprising a first end, a second end, and a length between the first end and the second end, wherein the length is greater than approximately 1 foot;

a first end member coupled to the plurality of extruded foam members at the first end such that the plurality of extruded foam members at the first end are contained by the first end member, wherein the first end member and the plurality of extruded foam members at the first end contained in the first end member form an integrated smooth end surface; and a second end member coupled to the plurality of extruded foam members at the second end such that the plurality of extruded foam members at the second end are contained by the second end member, wherein the second end member and the plurality of extruded foam members at the second end contained in the second end member form an integrated smooth end surface, wherein at least one of the plurality of extruded foam members is movable relative to the others of the plurality of extruded foam members along the length.

2. The apparatus of claim 1 wherein the extruded foam members are cylindrical.

3. The apparatus of claim 2 wherein the extruded foam members have a diameter of less than approximately 2 inches.

4. The apparatus of claim 3 wherein the diameter is between approximately 0.5 inches and 2 inches.

5. The apparatus of claim 1 wherein the extruded foam members are cylindrical and have a diameter of between approximately 1 and 3.5 inches.

6. The apparatus of claim 1 wherein the apparatus is buoyant.

7. The apparatus of claim 1 wherein each of the plurality of extruded foam members are arranged side-by-side, and the first and second members each comprise a wrap of foam material in a generally oblong shape.

8. The apparatus of claim 1 wherein the integrated smooth end surface is formed by heat bonding.

9. The apparatus of claim 1 wherein each of the plurality of extruded foam members are arranged side-by-side, and the first and second members each comprise at least two sheets of foam material where the plurality of extruded foam members are sandwiched between the at least two sheets of foam material.

10. The apparatus of claim 1 wherein the plurality of extruded foam members comprises at least three extruded foam members, and the first and second members comprise a wrap of foam material generally encircling the at least three extruded foam members.

11. The apparatus of claim 10 wherein the plurality of extruded foam members at the first end and the first end member as well as the plurality of extruded foam members at the second end and the second end member are heat bonded.

12. A multiple strand flotation device, comprising:

a first end member having a first shape;

a second end member having a second shape;

a plurality of individual strands having a corresponding plurality of first ends and second ends, wherein the plurality of first ends are arranged to be contained within the first shape of the first end and the plurality of second ends are arranged to be contained within the second shape of the second end, and wherein the plurality of first ends and the first end member are heat bonded together and the plurality of second ends and the second end member are heat bonded together forming an integrated smooth end surface.

13. The multiple strand flotation device of claim 12 wherein the plurality of individual strands have a diameter of less than about 2 inches.

14. The multiple strand flotation device of claim 12 wherein the plurality of individual strands are movable relative to each other over a length between the first end member and the second end member.

15. The multiple strand flotation device of claim 12 wherein the first shape and the second shape are different.

16. The multiple strand flotation device of claim 12 wherein the first shape and the second shape are generally circular.

17. The multiple strand flotation device of claim 12 wherein the first shape and the second shape are oblong.

18. A method of making a multiple strand pool noodle, comprising the steps of:

forming a plurality of foam members having a first end and a second end separated by a length;

arranging first ends of the plurality of foam members in a space formed by a first end member wherein a portion of each of the first ends of the plurality of foam members extend from the first end member;

heat bonding the first ends of the plurality of foam members and the first end member to couple the plurality of first ends of the plurality of foam members and the first end member to form an integrated smooth end surface;

arranging second ends of the plurality of foam members in a space formed by a second end member wherein a portion of each of the second ends of the plurality of foam members extend from the second end member; and heat bonding the second ends of the plurality of foam members and the second end member to couple the plurality of second ends of the plurality of foam members and the second end member to form an integrated smooth end surface.

19. The method of claim 18 wherein the portion of the first ends and the second ends has a length of about 0.5 inches.

20. The method of claim 18 wherein forming the plurality of foam members comprises the step of extruding the foam.

* * * * *